United States Patent [19]

Yamaguchi et al.

[11] 3,948,659

[45] Apr. 6, 1976

[54] METHOD OF PROCESSING COLOR PHOTOGRAPHIC MATERIALS

[75] Inventors: Seiya Yamaguchi; Isao Shimamura; Keiichi Adachi; Hidefumi Sera, all of Minami-ashigara, Japan

[73] Assignee: Fuji Photo Film Co., Ltd., Minami-ashigara, Japan

[22] Filed: Mar. 11, 1974

[21] Appl. No.: 449,810

[30] Foreign Application Priority Data

Mar. 9, 1973 Japan ..... 48-27666

[52] U.S. Cl. ..... 96/60 R; 96/60 BF

[51] Int. Cl.[2] ..... G03C 5/32

[58] Field of Search ..... 96/60 BF, 60 R

[56] References Cited

UNITED STATES PATENTS

| | | | |
|---|---|---|---|
| 2,611,700 | 9/1952 | Brunner et al. | 96/60 R |
| 3,748,136 | 7/1973 | Willems | 96/60 R |
| 3,767,401 | 10/1973 | Newman et al. | 96/60 BF |

*Primary Examiner*—Mary F. Kelley

*Attorney, Agent, or Firm*—Sughrue, Rothwell, Mion, Zinn & Macpeak

[57] ABSTRACT

In a bleach process or blix process for color photographic materials, the bleaching or blixing period of time can be shortened effectively by conducting the bleach or blix process in the presence of a metal complex salt of an organic acid and a compound having in the structural formula thereof the moiety of the formula

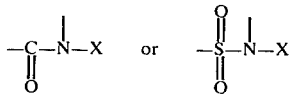

wherein X represents a halogen atom.

11 Claims, No Drawings

METHOD OF PROCESSING COLOR PHOTOGRAPHIC MATERIALS

BACKGROUND OF THE INVENTION

1. Field of the Invention

The present invention relates to a method of processing color photographic materials and, more particularly, it relates to a shortened method of bleaching or blixing color photographic materials by promoting the bleaching action of a bleaching agent.

2. Description of the Prior Art

The processing steps for color photographic materials such as, for instance, negative color photographic films, positive color photographic films, color photographic reversal films, color photographic papers, etc., include a bleach step for removing silver images (the so-called bleaching). The term "bleaching step" means the step of converting developed silver into a water-soluble silver salt using an oxidizing agent, i.e., a bleaching agent, and as the bleaching agent, potassium ferrocyanide, potassium bichromate, metal complex salts of organic acids, etc., are usually used.

Of these bleaching agents, potassium ferrocyanide or potassium bichromate can be used for processing color photographic materials containing a large amount of silver, such as negative color photograpic films and color photographic reversal films due to their high bleaching power but since the treatment or disposal of waste solutions containing potassium ferrocyanide or potassium bichromate has become troublesome from the standpoint of water pollution, a decreasing use of such a salt has been the recent tendency. On the other hand, because a metal complex salt of an organic acid does not give rise to pollution problems and further can be used together with a fixing agent in a color process (the so-called blix step), the problem of pollution and the problem of shortening the color process can be settled at the same time by employing such a complex salt. However, in using the metal complex salt of organic acid, a comparatively long period of time is required to finish the bleaching process due to the weak bleaching power of the complex salt and thus additionally a shortening of the bleaching period of time in such a case has been desired.

SUMMARY OF THE INVENTION

Therefore, an object of this invention is to provide a method of processing color photographic materials having a shortened bleaching period of time.

Another object of this invention is to provide a shortened method of bleaching or blixing color photographic materials by promoting the bleaching action.

Still another object of this invetion is to provide a bleaching promotor for a color process.

As the results of various investigations to attain the above objects, the inventors have discovered that a compound having in the structural formula at least one moiety of the formulas

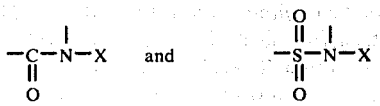

wherein X represents a halogen atom is suitable for the afore-mentioned objects. That is to say, according to the method of this invention, in removing silver images formed by development in a color process for silver halide color photographic materials, the above-described compound is used together with a metal complex salt of an organic acid as a bleaching agent.

DETAILED DESCRIPTION OF THE INVENTION

The compound used in the method of this invention together with the metal complex salt of an organic acid is a compound containing at least one moiety of the formulas

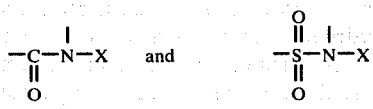

wherein X represents a halogen atom as described above. Of these two a compound containing a moiety of the formula

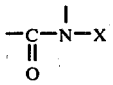

is more preferred. The important characteristic in the above-described formulas is that a halogen atom is bonded to the nitrogen atom and also a carbonyl group or a sulfonyl group is bonded to the nitrogen atom. The nitrogen atom, and the carbon atom, or the nitrogen atom and the sulfur atom of the each formula may be bonded to other atoms or groups or may further combine to form a ring. In this invention the cyclic saturated and unsaturated compounds of the latter formula type are particularly preferable and among them the cyclic compounds in which the nitrogen atom of the moiety

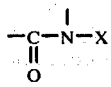

is additionally bonded to another carbonyl group or sulfonyl group are most desirable. Of the cyclic compounds, those involving a 5-membered ring or a 6-membered ring are preferable but the compound containing a moiety of the above-described formula and also containing a ring other than the above-described cyclic ring, such as a benzene ring, or another substituent, such as an alkyl group, can be effectively used in this invention.

As the cyclic compounds as indicated above, there are N-halogen phthalimides, N-halogen succinimides, N-halogen saccharins, N-halogen barbituric acids, N-halogen hydantoins N-halogen isocyanuric acids, etc. The cyclic compounds may contain two or more moieties of the structure

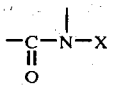

or in other words, the cyclic compound may have two or more nitrogen atoms each substituted with a halogen atom.

Other compounds which can be used in this invention are those compounds in which each of the nitrogen atom and the carbon atom or each of the nitrogen atom and the sulfur atom is bonded to another atom or group. Examples of atoms and groups bonded to each of the nitrogen atom and the carbon atom or each of the nitrogen atom and the sulfur atom are atoms such as a hydrogen atom, an alkali metal atom (such as sodium, potassium, lithium and cerium), etc., and groups such as an alkyl group (e.g., having 1 to 12 carbon atoms), an aralkyl group (such as substituted and unsubstituted benzyl and phenethyl groups), an aryl group (such as unsubstituted and substituted phenyl, tolyl and napthyl groups), etc. In the more preferred compounds belonging to this class, a hydrogen atom or an alkali metal atom is bonded to the nitrogen atom and an alkyl group, an aralkyl group, or an aryl group is bonded to the carbon atom or the sulfur atom.

Thus, on summarizing the above-described considerations on compounds which can be used in this invention, the compounds can be represented by the general formula

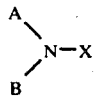

wherein A represents —COR, —$SO_2R$ or R; B represents —COR′, —$SO_2R'$, a hydrogen atom, or an alkali metal atom (as hereinbefore defined), provided that when A represents R, B represents either —COR′ or —$SO_2R'$; X represents a halogen atom (such as chlorine, bromine and iodine); and R and R′ each represents a non-metallic atomic group (such as the alkyl, aralkyl and aryl groups hereinbefore defined), and where R and R′ may combine to form a heterocyclic group (such as those heterocyclic groups containing 5- or 7-membered rings which can be a part of a condensed ring system).

Specific examples of compounds of the above general formula which can be used in this invention are N-chlorophthalimide, N-bromophthalimide, N-chlorosuccinimide, N-bromosuccinimide, N-iodosuccinimide, N,N′-dichlorodiethylbarbituric acid, N,N′-dibromodiethylbarbituric acid, 3-chloro-5,5-dimethylhydantoin, 1,3-dichloro-5,5-dimethylhydantoin, 1,3-diiodo-5,5-dimethylhydantoin, N-chlorosaccharin, N-bromosaccharin, 1,3-dibromo-5,5-dimethylhydantoin, N-bromo-ε-caprolactam, sodium dichloroisocyanurate, potassium dichloroisocyanurate, trichloroisocyanuric acid, N-bromoacetamide, N-iodobutylamide, N-iodobenzamide, benzenesulfonchloramide sodium salt (dihydrate), p-toluenesulfonchloramide sodium salt (dihydrate), etc.

The amount of the above compound can be appropriately varied depending on the kind and concentration of the bleaching agent and the kind of color photographic materials to be processed but since the bleach promoting effect is reduced as the amount of the compound is reduced and also since precipitates are formed or dye images are reduced if the amount thereof becomes larger, it is necessary to determine experimentally the appropriate amount of the compound. Usually, however, the amount of the compound is about 0.005 to 50 g, preferably about 0.05 to 5 g per liter of the solution containing a bleaching agent.

The bleaching agent which can be used together with the above-described compound is a complex salt of an organic acid and a metal (a polyvalent cation). The term "polyvalent cation" means a metal, which can possess two or more oxidation states and which is in its higher oxidation state. More specifically, the multivalent cation is a metal having a capability of oxidizing metallic silver. Such polyvalent cations are iron (III), cobalt (III), copper (II), etc., and among them iron (III) is most preferred.

Also, the compounds represented by the followng formulas can be preferably used as the organic acid for the metal complex salt used in this invention. In the general formulas shown beow, one or more carboxyl groups may have been substituted by water-ionizable atoms or groups such as an alkali metal and an ammonium group.

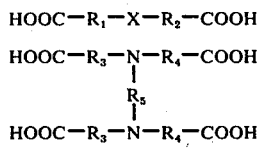

wherein $X$ represents a hydrocarbon group, an oxygen atom, a sulfur atom, or —$NR_6$; $R_1$, $R_2$, $R_3$, $R_4$, and $R_5$ each represents a substituted or unsubstituted hydrocarbon group; and $R_6$ represents a hydrogen atom or a substituted or unsubstituted hydrocarbon group.

Of the compounds represented by these general formulas, polyaminopolycarboxylic acids are most practical for use. Specific examples of organic acids which can be used in this invention are malonic acid, tartaric acid, ethylmalonic acid, malic acid, fumaric acid, diglycolic acid, thioglycolic acid, nitrotriacetic acid, ethylenediamine tetraacetic acid, aminotriacetic acid, ethylenedithioglycolic acid, dithioglycolic acid, diethylenetriamine pentaacetic acid, ethyleneglycol bis-(aminoethylether)tetraacetic acid, diaminopropanoltetraacetic acid, N-hydroxyethylenediamine triacetic acid, ethyliminodipropionic acid, cyclohexane diaminetetraacetic acid, etc.

The metal complex salts described above are disclosed in the specifications of German Patent No. 866,605; British Patent No. 746,567; British Patent No. 933,008; and U.S. Pat. Nos. 3,582,322 and 3,227,550.

The above described organic acids form readily stable ferric chelate compounds in an aqueous solution with a ferric salt such as ferric chloride, ferric sulfate and iron alum. Therefore, in the present invention, the organic acid and the ferric salt may be present in an aqueous solution or the ferric complex salt of the organic acid may be used as the metal complex salt. The most generally used ferric complex salt of an organic acid is the ferric complex salt of ethylenediamine tetraacetic acid, which has a high bleaching power and is readily available. Complex salts of other metals with these organic acids can also be used in this invention. Where desired two or more complex salts can be used in the invention.

The content of the complex salt of the organic acid in the aqueous solution containing a bleaching agent usually ranges from about 20 to 200 g per liter, preferably 30 g to 120 g per liter, for practical purposes but the content of the complex salt can be further changed without adversely influencing the bleaching action of the solution. Where two components are used to form the complex salt in situ in the solution, a suitable amount of the organic acid ranges from about 20 to 100 g per 1 liter of the solution, and a suitable amount of the metal compound ranges about 10 to 80 g per 1 liter.

The solution containing the bleaching agent used in this invention includes a bleach solution and a blix solution. The solution contains the above-described compound and the metal complex salt of the organic acid as the necessary components. In using the solution containing these components as the blix solution in a color process, a solvent for silver halide may be incorporated in the solution since the blix solution is used for bleaching and fixing simultaneously in one step. Examples of such solvents for silver halide are compounds conventionally known as fixing agents, for instance, thiosulfates such as sodium thiosulfate, thiocyanates such as potassium thiocyanate, sulfurcontaining organic dibasic acids such as bisthiolglycolic acid, organic diols such as 3-thia-1,5-pentandiol, and imidazolidinethion. Blix solutions are also described in detail in the specifications of the above-mentioned patents. The content of the bleaching agent in the blix solution is sufficient in the above-described amount and the content of the fixing agent is that amount of fixing agent usually present for conventional color photographic processing. Generally, the content of the fixing agent is about 40 to 400 g per liter, preferably 50 to 300 g per liter, of the solution. The solution containing the bleaching agent is preferably acidic or has a pH of about 5.0 to 7.5 for practical purposes. The pH of the solution may be adjusted using pH adjusting agents well known in the photographic art (such as sodium carbonate, sodium hydroxide, acetic acid and citric acid). The selection of the pH adjusting agent is not of serious concern in this invention because the agent is used only for maintaining the solution containing the bleaching agent in an acid condition.

The aqueous solution containing the fixing agent used in this invention may further contain a bleach promotor such as potassium bromide, potassium iodide, sodium iodide, a polyalkylene oxide, 2-mercaptoimidazole, 3-mercapto-1,2,4-triazole, thiourea, ethylene thiourea, selenium compounds, and the onium compounds described in *The Journal of Photographic Science;* Vol. 15, No. 5, 113–120 (1971). Also, the solution may contain a hydroxylamine salt, p-aminophenol, hydroxymorpholine, ascorbic acid, 1-phenyl-3-pyrazolidone, semicarbazide, the aminomethylquinone or the salts thereof as described in the specification of U.S. Pat. No. 3,671,259, or a hydrazine salt for preventing the occurence of bleach fog. These additives can suitably be used in an amount of from about 1 to 100 g per liter of the solution.

Furthermore, the solution may contain other additives well known as additives for bleach solutions or blix solutions in the color process. Suitable examples of these additives are nitrates such as sodium nitrate, a small amount of a sulfite, a small amount of a mercapto compound such as mercapto triazole, a pH buffer agent such as a borate, a citrate, an acetate, a carbonate, a phosphate, etc., a stain preventing agent such as formamidinosulfinic acid, the polyamine compounds as described in the specification of U.S. Pat. No. 3,578,454, the alkylamine compounds as described in the specification of U.S. Pat. No. 3,578,453, the iodides as described in the specification of German Patent No. 1,127,715, the polyethylene oxides as described in the specification of German Patent No. 966,410, and the nitrogen-containing heterocyclic compounds as described in the specification of German Patent No. 1,290,812. The amount of these compounds can be varied depending on the kind of compound employed but generally will range from about 0.1 to 50 g per liter of solution.

Also, the bleaching agent-containing solution used in this invention may contain a water-soluble fluorescent whitening agent such as, for instance, Uvitex (trade name, produced by CIBA Ltd.), Tinopal (trade name, produced by Geigy AG), Hakkol (trade name, produced by Showa Kagaku Co., Ltd.), Whitex (trade name, produced by Sumitomo Chemical Industries Co., Ltd.), etc., for providing an image stibilization action and whitening action to the solution and further the solution may contain a surface active agent such as polyalkylene glycol as a spreading agent.

The solution containing the bleaching agent used in this invention may be stored in a concentrated state and such a concentrated solution may be diluted with water on use.

The color developer used in the color process including the method of this invention is an alkaline aqueous solution containing an aromatic primary amine color developing agent and preferably benzyl alcohol. Examples of such color developing agents are phenylenediamine derivatives such as N,N-diethyl-p-phenylenediamine sulfate, 4-amino-N-ethyl-N-β-hydroxyethylaniline sulfate, 3-methyl-4-amino-N-ethyl-β-methanesulfoamidoethylaniline sesquisulfate monohydrate, 3-methyl-4-amino-N-ethyl-N-62 -hydroxyethylaniline sulfate, 3-methyl-4-amino-N,N-diethylaniline hydrochloride, 3-methyl-4-amino-N-ethyl-N-(2-methoxyethyl)-m-toluidinedi-p-toluene sulfonate, etc. The color developer may further contain other additives such as an alkali metal sulfite, a carbonate, a bisulfite, a bromine, an iodide, an antifoggant, a development accelerator, and a solvent such as diethylene glycol.

The color process including the step of this invention may further include, in addition to color development and bleach and fix (or blix), a stop bath, an image stabilization bath, a hardening bath, a neutralization bath, and black and white development.

Some of these developers and development steps are disclosed in U.S. Pat. Nos. 2,193,015; 2,592,363 and 3,592,364.

Where the method of this invention comprises a bleach step and fix step, any conventional fix solution can be used in the fixing step followed by the bleaching step. That is to say, as the fixing agent, ammonium thiosulfate, sodium thiosulfate, or potassium thiosulfate can be used in an amount of about 50 to 300 g/liter. The fix solution may further contain a stabilizer such as a sulfite or a pyrosulfite, a hardening agent such as potassium alum, and a pH buffer agent such as an acetate and a borate.

The method of this invention can be applied to a development system of the type in which couplers are incorporated in photographic emulsion layers of the color photographic materials (as described in, e.g., the specifications of U.S. Pat. Nos. 2,376,679; 2,322,027; and 2,801,171) as well as to a development system of the type in which couplers are incorporated in the developers (as described in, e.g., the specifications of U.S. Pat. Nos. 2,252,718; 2,592,243; and 2,590,970).

The method of this invention can be applied to the color process for conventional silver halide color photographic materials such as color photographic negative films, color photographic papers, color photographic positive films, color photographic reversal films for slides, color photographic reversal cine films, color photographic reversal TV films, etc., for example, as disclosed in U.S. Pat. Nos. 2,944,900; 3,547,640 and 3,582,322.

As is well known, the above-described various kinds of color photographic materials are processed each using a different color process. That is to say, the processing steps for color photographic negative films and color photographic positive films include generally color development, stop-fixing, bleaching, fixing, water washing, and stabilization (with sometimes the stop-fixing step being omitted), the processing steps for color photographic papers include generally color development, bleaching, fixing (or blixing in place of bleaching and fixing), washing, and stabilization, and the processing steps for reversal color photographic materials include generally first development (black and white development), stop-hardening, color development, stop-hardening (or rinsing), bleaching, fixing, washing, and stabilization (with sometimes a pre-hardening step and a neutralization step being conducted prior to the first development). Of course, the above-described processes may be modified but the step of processing the solution containing the bleaching agent by the present invention is always common to all of the processes. Therefore, in the practice of the method of this invention, the other steps employed in the color process which includes the step of this invention are not restricted, in other words, the method of this invention can be employed in any color processes conventionally known in the photographic art.

The compositions for the processing solutions used in such various color processes are illustrated below although the compositions of the solutions in this ivnention are not limited to these compositions only.

For instance, the composition for the first developer can contain a developing agent such as a monomethyl p-aminophenol, a hydroquinone, a 3-pyrazolidone, etc., and a salt such as sodium sulfite, sodium carbonate, potassium bromide, potassium thiocyanide; the composition for the stop-fix solution can contain a thiosulfate, potassium pyrosulfite, glacial acetic acid, etc.; the composition for the stop-hardening solution can contain potassium alum, sodium sulfate, boric acid, sodium acetate, glacial acetic acid, etc.; the composition for the rinse solution can contain potassium pyrosulfite, etc.; the composition for the stabilization solution can contain formaldehyde, a surface active agent; the composition for the pre-hardening solution can contain formaldehyde, sodium sulfate, 2,5-dimethoxytetrahydrofuran, potassium bromide, etc.; and the composition for the neutralization solution can contain sodium acetate, potassium pyrosulfite, sodium sulfate, glacial acetic acid, etc.

The development can be conducted under conditions conventionally employed in the art (including, e.g., high temperature conditions).

The layer constructions of the color photographic materials which can be processed using a color process including the step of this invention are described below, but it will be clear that the invention is not limited to these illustrations.

A color photographic negative film or a color photographic reversal film generally has a construction comprising a transparent support such as a cellulose triacetate film having coated thereon an antihalation layer, a red-sensitive emulsion layer containing a cyan coupler, a green-sensitive emulsion layer containing a magenta coupler, a yellow filter layer, a blue-sensitive emulsion layer containing a yellow coupler, and a gelatin protective layer in this order from the support.

A color photographic paper generally has a construction comprising an opaque support having coated thereon a blue-sensitive emulsion layer containing a yellow coupler, a green-sensitive emulsion layer containing a magneta coupler a red-sensitive emulsion layer containing a cyan coupler, and a gelatin protective layer in this order from the support.

A color photographic positive film generally has a construction comprising a transparent support such as a cellulose triacetate film and a polyethylene terephthalate film having a black resin backing layer and on the opposite surface from the backing layer a blue-sensitive emulsion layer containing a yellow coupler, a red-sensitive emulsion layer containing a cyan coupler, a green-sensitive emulsion layer containing a magenta coupler, and a gelatin protective layer.

Also, the method of this invention can be applied to the so-called packet-type color photographic material as described in U.S. Pat. No. 2,698,794. That is to say, the present invention is also applicable to a color photographic material having a single layer containing dispersed therein a mixture of packets containing a blue-sensitive emulsion and a yellow coupler, packets containing a green-sensitive emulsion and a magenta coupler, and packets containing a red-sensitive emulsion and a cyan coupler.

Photographic layers formed on a support in a conventional color photographic material generally also include one or more silver halide emulsion layers, intermediate layers, a filter layer, a protective layer, an antihalation layer, and a backing layer. The silver halide emulsion for the emulsion layer can be prepared by dispersing in a hydrophilic colloid a silver halide such as silver chloride, silver iodide, silver bromide, silver chloroiodide, silver chlorobromide, silver iodobromide, and silver chloroiodobromide, etc.

The silver halide emulsion is usually prepared by mixing an aqueous solution of a silver salt such as silver nitrate and aqueous solution of a water-soluble halide such as potassium bromide in the presence of aqueous polymer solution such as a gelatin solution. The silver halide grains can be prepared using conventional techniques. Of course, it is advantageous to employ a single jet method, a double jet method, or a control jet method in the preparation of silver halide grains. Also, two or more separately prepared silver halide photographic emulsions may be mixed. Furthermore, the silver halide grains can have a uniform crystal structure or can have a layer structure such that the surface layer of the silver halide grain is different in quality from the core of the grain. Also, the silver halide grains can be a so-called conversion type silver halide grain as disclosed in the specifications of British Patent No. 635,841 and U.S. Pat. No. 3,622,318. Also, the silver halide grains can be a type in which a latent image is formed mainly in the surface layer of the grains or may be a type in which a latent image is formed in the inside of the grain. These photographic emulsions are also described in Mees et al.; *The Theory of Photographic Process* processed by Mac Millan Co. and Grafikides; *Photographic Chemistry* published by Fountain Press Co. As described in the above literature, these photographic emulsions can be prepared using various methods such as an ammonia method, a neutralization method, and an oxidation method.

After preparing the silver halide grains, they are washed with water to remove from the system the by-produced water-soluble salts, e.g., potassium nitrate when silver bromide is produced using silver nitrate and potassium bromide, and then a heat treatment of the silver halide grains is conducted in the presence of a chemical sensitizer, whereby the sensitivity thereof is increased without increasing the size of the silver halide grains.

Suitable hydrophilic colloids which can be used as the vehicles for the silver halide are protein and cellulose derivatives such as gelatin colloidal albumin, casein, carboxymethyl cellulose, hydroxyethyl cellulose, etc.; sugar derivatives such as agar agar, sodium alginate, starch derivatives, etc.; and synthetic hydrophilic colloids such as polyvinyl alcohol, poly-N-vinyl pryolidone, polyacrylic acid copolymers, polyacrylamide, derivatives of polyacrylic amide, etc. If desired, the above-described hydrophilic colloids can be used as a co-miscible mixture of two more such colloids. Among them, gelatin is most generally used but a part or all of the gelatin can be replaced with a synthetic polymer or further a so-called derivative prepared by treating the functional groups of the gelatin molecule, such as the amino groups, imino groups, hydroxyl groups, and/or carboxyl groups, with a reagent having one group reactive to such a functional group can be used. Furthermore, a graft polymer obtained by grafting to gelatin the molecular chain of other polymers can also be used.

Examples of reagents for preparing the above-described derivatives are isocyanates, acid chlorides, and acid anhydrides as described in the specification of U.S. Pat. No. 2,614,928; the acid anhydrides as described in the specification of U.S. Pat. No. 3,118,766; the bromoacetic acids as described in the specification of Japanese Patent Publication No. 5514/1954; the phenylglycidyl ethers as described in the specification of Japanese Patent Publication No. 26845/1967; the vinylsulfone compounds as described in the specification of U.S. Pat. No. 3,132,945; the N-allylvinylsulfonamides as described in the specification of British Patent No. 861,414; the maleinimide compounds as described in the specification of U.S. Pat. No. 3,186,846; the acrylonitriles as described in the specification of U.S. Pat. No. 2,594,293; the polyalkyleneoxides as described in the specification of U.S. Pat. No. 3,312,553; the epoxy compounds as described in the specification of Japanese Patent No. 26,845/1967; the esters as described in the specification of U.S. Pat. No. 2,763,639; and the alkansultones as described in the specification of U.S. Pat. No. 3,539,353.

The branched polymers grafted to gelatin for producing the above-described graft polymer are described in, e.g., the specifications of U.S. Pat. Nos. 2,763,625; 2,831,767; and 2,956,884, *Polymer Letters*, 5, 595 (1967), *Photographic Science Engineering*, 9, 148 (1965), and *Journal of Polymer Science*, A-1, 9, 3199 (1971) but polymers or copolymers of vinyl monomers such as acrylic acid, methacrylic acid and the ester, amide and nitrile derivatives of acrylic acid or methacrylic acid can be generally used. However, those hydrophilic vinyl polymers having some miscibility with gelatin, for instance, the polymers or copolymers of acrylic amides, methacrylic amides, hydroxyalkyl acrylates, hydroxyalkyl methacrylates, etc., are particularly desirable.

It is preferable that the photographic layers processed in accordance with this invention be hardened using an aldehyde hardening agent such as formaldehyde, a non-aldehyde hardening agent such as 2-hydroxy-4,6-dichloro-S-triazine sodium salt, or using combination of these hardening agents. Suitable hardeners are described in U.S. Pat. Nos. 3,288,775; 2,732,303; 3,565,632; 3,677,760; 3,582,322; 3,635,718, 3,232,763; 2,732,316; 2,586,168; 3,103,437, 3,017,280; 2,983,611; 2,725,294; 2,725,295, 3,100,704; 3,091,537; 3,321,313; and 3,543,292. Furthermore, the photographic layers can contain conventional additives such as sensitizers as disclosed in U.S. Pat. Nos. 2,339,083; 2,540,085; 2,597,856; 2,597,915; 2,448,060; 2,540,086; 2,566,245; 2,566,263; 2,598,079; 1,574,944; 2,410,689; 3,189,458; 3,501,313; 2,487,850; 2,518,698; 2,521,925; 2,521,926; 2,694,637; 2,983,610; and 3,201,254, sensitizing dyes as disclosed in U.S. Pat. Nos. 2,493,748; 2,519,001; 2,977,229; 3,480,434; 3,672,897; 3,703,377; 2,688,545; 2,912,329; 3,397,060; 3,615,635; 3,628,964; 3,511,664; 3,522,052; 3,527,641; 3,615,613; 3,516,632; 3,617,295; 3,635,721; and 3,694,217, stabilizers as disclosed in U.S. Pat. Nos. 1,758,576; 2,110,178; 2,131,038; 2,173,628; 2,697,040; 2,304,962; 2,324,123; 2,394,198; 2,444,605; 2,444,606; 2,444,607; 2,444,608; 2,566,245; 2,694,716; 2,697,099; 2,708,162; 2,728,663; 2,728,664; 2,728,665; 2,476,536; 2,824,001; 2,843,491; 2,886,437; 3,052,544; 3,137,577; 3,220,839; 3,226,231; 3,236,652; 3,251,691; 3,252,799; 3,287,135; 3,326,681; 3,420,668; and 3,622,339, surface active agents as disclosed in U.S. Pat. Nos. 2,271,623; 2,340,472; 2,288,226; 2,739,891; 3,068,101; 3,158,484; 3,201,253; 3,210,191; 3,294,540; 3,415,649; 3,441,413; 3,442,654; 3,475,174; and 3,545,974, etc.

Any of the couplers generally used in the art can be used as the couplers contained in the photographic materials or color developers in this invention. That is to say, as the cyan coupler, a coupler having a naphthol or phenol fundamental structure and capable of forming indoaniline dye upon coupling is used, for example, as disclosed in U.S. Pat. Nos. 2,474,293; 2,698,794; 3,034,892; 3,214,437; 3,253,924; 3,311,476; 3,458,315; 3,591,383; and 3,582,322, as the magenta coupler, a coupler having an active methylene-containing 5-pyrazolone ring as the skeletal structure is used, for example, as disclosed in U.S. Pat. Nos. 2,600,788; 2,983,608; 3,006,759; 3,062,653; 3,214,437; 3,253,924; 3,419,391; 3,419,808; 3,476,560; and 3,582,322, and as the yellow coupler, a coupler of a benzoylacetanilide structure, a pivalylacetanilide structure, or an acylacetanilide structure, for example, as disclosed in U.S. Pat. Nos. 3,277,157; 3,415,652; 3,447,928; 3,311,476; 3,408,194; 2,875,057; 3,265,506; 3,409,439; 3,551,155; 3,551,156; and 3,582,322, which may or may not have a substituent at the coupling position is used.

The pyrazolone-type couplers which can be used in this invention are, in general, represented by the following general formula

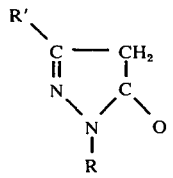

wherein R represents a substituted or unsubstituted alkyl group, a substituted or unsubstituted aryl group, or a substituted or unsubstituted heterocyclic group and R′ represents an alkyl group, a carbamyl group, an amino group, or an amide group.

Specific examples of the above-illustrated pyrazolone couplers are shown below:

1-p-sec-Amylphenyl-3-n-amyl-5-pyrazolone,
2-Cyanoacetyl-5-(p-sec-amylbenzoylamino)cumarone,
2-Cyanoacetylcumarone-5-(N-n-amyl-p-t-amylsulfoanilide),
2-Cyanoacetylcumarone-5-sulfone-N-n-butylanilide,
1-p-Laurylphenyl-3-methyl-5-pyrazolone,
1-β-Naphthyl-3-amyl-5-pyrazolone,
1-p-Nitrophenol-3-n-amyl-5-pyrazolone,
1-Phenyl-3-acetylamino-5-pyrazolone,
1-Phenyl-3-n-valeramino-5-pyrazolone,
1-Phenyl-3-chloroacetylamino-5-pyrazolone,
1-Phenyl-3-(m-aminobenzoyl)amino-5-pyrazolone,
1-p-Phenoxyphenyl-3-(p-t-amyloxybenzoyl)amino-5-pyrazolone,
1-(2′,4′,6′-Trichlorophenyl)-3-benzamido-5-pyrazolone,
1-(2′,4′-Dichlorophenyl)-3-[3″-(2‴, 4‴-di-t-amylphenoxyacetamido)benzamido]-5-pyrazolone,
1-(2,4-Dimethyl-6-chlorophenyl)-3-[3″-(2‴,4‴-di-t-amylphenoxyacetamido)benzamido]-5-pyrazolone.

Also, the magenta couplers in this invention include the four-equivalent couplers disclosed in the specification of British Patent No. 1,142,553 and the specification of U.S. Pat. No. 3,337,344.

Furthermore, examples of the benzoylacetanilide-type and pivaloylacetanilide-type four-equivalent couplers which give yellow dyes upon coupling are the yellow couplers as described in the specification of British Patent No. 1,113,038 and the specification of U.S. Pat. No. 3,337,344 and also the yellow couplers as illustrated below:

α-{3-[α-(m-Pentadecylphenoxy)butylamino]benzoyl}-2-chloroacetanilide,
α-{3-[α-(2,4-Di-t-amylphenoxy)butylamido]benzoyl}2-methoxyacetanilide,
α-{3-[α-(2,4-Di-t-amylphenoxy)acetamido]benzoyl}-2-chloroacetanilide,
2-Chloro-3′-[4-(2,4-di-t-amylphenoxy)butylamido]-benzoylacetanilide,
α-{3-[α-(2,4-Di-t-amylphenoxy)acetamido]benzoyl}benzoylacetanilide,
α-Pivalyl-2,5-dichloro-4-[N′-(n-octadecyl)-N′-methylsulfamyl]acetanilide,
α-Pyvalyl-2-chloro-5-[α-(2′,4′-di-tert-amylphenoxy)-butylamide]acetoanilide, and
α-(2′,4′-Dimethoxybenzoyl)-2-chloro-5-(2′-hexyldecyloxycarbonyl)acetoanilide.

The above-illustrated examples are four-equivalent couplers to be incorporated in the photographic emulsion layers of the photographic materials processed by the method of this invention but the couplers in this invention are not limited to only these couplers.

As a matter of course, photographic materials containing two-equivalent couplers can be also processed by the method of this invention. Such two-equivalent couplers are described in the specification of U.S. Pat. No. 3,582,322.

Examples of the cyan dye-forming couplers are shown below:

5-(p-Amylphenoxybenzenesulfoamino)-1-naphthol,
5-(N-Benzyl-N-napthalenesulfoamino)-1-naphthol,
5-(N-Benzyl-N-n-valerylamino)-1-naphthol,
5-Caproylamino-1-naphthol,
2-Chloro-5-(p-nitrobenzoyl-β-o-hydroxyethylamino0-1-naphthol, -O-hydroxyethylamino)-
2-Chloro-5-palmitylamino-1-naphthol,
5-Diphenylethersulfoamido-1-naphthol,
1-Hydroxy-2-(N-sec-amylphenyl)naphthamide,
5-Phenoxyacetamino-1-naphthol,
Monochloro-5-(N-γ-phenylpropyl-N-p-sec-amylbenzoylamino)-1-naphthol,
2-Acetylamino-5-methylphenol,
2-Benzoylamino-3,5-dimethylphenol,
2-Hydroxy-2-[δ-(2,4-di-t-amylphenoxy-n-butyl]-naphthamide,
2-(4″-t-Amyl-3′-phenoxybenzoylamino)phenol.

The advantages obtained with the method of this invention are explained below.

1. In the method of this invention the bleach treatment for photographic materials containing a large amount of silver, for which the bleach treatment using a solution containing a conventional silver complex salt of an organic acid as the bleaching agent has been difficult, becomes possible and further it is unnecessary to use a bleaching agent which causes pollution problems, such as potassium ferricyanide. Namely, as the bleaching agent for bleaching developed photographic materials containing a large amount of silver, such as negative color photographic films, positive color photographic films, reversal color photographic films, etc., potassium ferricyanide, potassium bichromate, etc., having a high bleaching power, have been used and thus the use of such a bleach solution is undesirable from a view point of pollution. On the other hand, by the method of this invention the metal complex salt of the organic acid which does not give rise to such pollution problems is used as the bleaching agent and hence the treatment of the waste solution and washing solution can be conducted easily. Furthermore, the bleaching promotor used in this invention does not give rise to any particular problem on pollution and can be used in a low concentration, which stabilizes the employment of such a bleaching promotor.

2. The blix process can be promoted by employing the method of this invention. Since a bleaching agent such as potassium ferricyanide, potassium bichromate, etc., can not be used together with a fixing agent such as a thiosulfate, etc., in an aqueous solution, such a bleach-agent can not be used in a blix solution. However since a metal complex of organic acid can be used in an aqueous solution containing a thiosulfate, the metal complex salt of this invention can be used as the bleaching agent for a blix solution for processing color photographic materials. Furthermore, by adding the bleaching promotor in this invention to a blix solution, the period of time required for finishing the blix step can be shorted to about half the time conventionally required. Also, in general, if the amount of a metal complex salt of the organic acid in the blix solution is increased, the period of time required for finishing the blix treatment can be shortened but the increase of such a metal complex salt is restricted from the standpoint of solubility and cost of the material. On the other hand, when the bleaching promotor in this invention is used, the bleaching period of time can be shortened without the necessity for increasing the content of the bleaching agent and thus the method of this invention is effective for the prevention of precipitation of the bleaching agent at low temperatures and is economically advantageous.

The following examples are given to illustrate the present invention in greater detail. Unless otherwise indicated, all percents, parts, ratios and the like are by weight.

EXAMPLE 1

A cellulose acetate film base was coated in a thickness of about 3 microns with a black antihalation layer comprising black colloidal silver and gelatin, a red-sensitive silver iodobromide (iodide: 5.5 mol%) emulsion layer containing 1-hydroxy-4-[O-(2-hexyldecyloxycarbonyl)-phenylazo]-2-[N-(1-naphthyl)]-naphthamide at 0.88 g/m² and in a layer thickness of 5 μ, a green sensitive silver iodobromide (iodide: 5.5 mol%) emulsion layer containing 1-(2,4,6-trichlorophenyl)-3-[3-(2,4-di-tert-amylphenoxyacetamido)-benzamido]-4-(4-methoxyphenylazo)-5-pyrazolone at 0.75 g/m and in a layer thickness of 6 μ, a yellow filter layer, a blue-sensitive silver iodobromide (iodide: 5.5 mol%) emulsion layer containing 5-[α-(2,4-di-tert-amylphenoxy)acetamido]-(4-methoxbenzoyl)acetanilide at 1.31 g/m² and in a layer thickness of 6 μ, and a gelatin protective layer in this order to provide a negative color photograhic film.

The color photographic film thus prepared was exposed through an optical wedge by means of a sensitometer and then processed by the following developing processings:

| Processing Steps | | |
|---|---|---|
| 1. Color Development | 24°C | 14 minutes |
| 2. Stop | 23 – 25°C | 4 minutes |
| 3. Hardening | " | 4 minutes |
| 4. Wash | " | 4 minutes |
| 5. Bleach | " | 6 minutes |
| 6. Wash | " | 4 minutes |
| 7. Fix | " | 8 minutes |
| 8. Wash | " | 8 minutes |
| 9. Stabilization | " | 1 minute |
| 10. Drying | | |

The processing solutions used in the above steps had the following compositions:

| | |
|---|---|
| Color Developer: | |
| Sodium Hexametaphosphate | 2.0 g |
| Benzyl Alcohol | 8.5 ml |
| Sodium Metaborate | 35.0 g |

-continued

| | |
|---|---|
| Sodium Tertiary Phosphate | 25.0 g |
| Sodium Sulfite (Anhydrous) | 2.5 g |
| Potassium Bromide | 1.5 g |
| Potassium Iodide | 6.0 mg |
| 4-Amino-N-ethyl-N-(β-methanesulfonamidoethyl)-m-toluidene.3/2 Sulfate (monohydrate) | 7.8 g |
| Water added to make | 1 liter |
| pH 10.5 | |
| Stop Solution: | |
| Glacial Acetic Acid | 20 ml |
| Sodium Sulfite (Anhydrous) | 10 g |
| Water added to make | 1 liter |
| pH 4.5 | |
| Hardening Solution: | |
| Formaldehyde (37% aqueous solution) | 20 ml |
| Sodium Carbonate (Anhydrous) | 10 g |
| Water added to make | 1 liter |
| pH 10.6 | |
| Bleach Solution: | |
| Sodium Carbonate (Anhydrous) | 15 g |
| Potassium Bromide | 30 g |
| Ferric Complex Salt of Ethylenediamine Tetraacetic Acid | 100 g |
| Bleaching Promotor (N-iodosuccinimide) | 250 mg |
| Water added to make | 1 liter |
| pH 6.7 | |
| Fix Solution: | |
| Ammonium Thiosulfate | 120 g |
| Potassium Pyrosulfite | 20 g |
| Water added to make | 1 liter |
| pH 4.5 | |
| Stabilization Solution: | |
| Polyethylene Glycol (40% aqueous solution; mean molecular weight - 400) | 10 ml |
| Formaldehyde (37% aqueous solution) | 10 ml |
| Water added to make | 1 liter |
| pH 7.5 | |

When the bleaching promotor was not added to the bleach solution, the bleaching step was not finished even when the bleach treatment was conducted for 15 minutes in the experiment as shown above.

EXAMPLE 2

A polyethylene-coated paper support as described in the specification of U.S. Pat. No. 3,448,000 was coated with a blue-sensitive silver chlorobromide emulsion layer containing α-(2-methylbenzoyl)-3-[α-(2,4-di-tert-amylphenoxy)acetamido]acetanilide, a green-sensitive silver chlorobromide emulsion layer containing 1-phenyl-3-[3-(4-tert-aminophenoxy)benzamido]-5-pyrazolone, a red-sensitive silver chlorobromide emulsion layer containing 1-hydroxy-4-chloro-N-hexadecyl-N-(2-cyanoethyl)-2-naphthamide, and a gelatin protective layer in this order to provide a color photographic paper.

The color photographic paper was exposed through an optical wedge by means of a sensitometer and then processed by the following processing steps.

| Processing Steps | | |
|---|---|---|
| 1. Color Development | 31°C | 3 min. 30 sec. |
| 2. Blix | " | 40 minutes |
| 3. Wash | " | 2 minutes |
| 4. Stabilization | " | 1 minute |
| 5. Rinse | " | 30 seconds |
| 6. Dyring | | |

The processing solutions used in the above steps had the following compositions.

| | |
|---|---|
| Color Developer: | |
| Sodium Metaborate | 25 g |
| Sodium Sulfite (Anhydrous) | 2 g |
| Hydroxylamine Sulfate | 2 g |
| Potassium Bromide | 0.5 g |

-continued

| | |
|---|---|
| Sodium Hydroxide | 3.4 g |
| Benzyl Alcohol (35% aqueous solution) | 45 ml |
| 4-Amino-N-ethyl-N-(β-methanesulfone-amidoethyl)-m-toluidine.3/2 Sulfate (monohydrate) | |
| Water added to make | 1 liter |
| pH 10.2 | |
| Blix Solution: | |
| Ferric Complex Salt of Ethylenediamine Tetraacetic Acid | 40 g |
| Sodium Carbonate (Anhydrous) | 3 g |
| Sodium Thiosulfite (Anhydrous) | 150 g |
| Sodium Sulfite (Anhydrous) | 10 g |
| Bleaching Promotor (1,3-dibromo-5,5-dimethylhydantoin) | 1 g |
| N,N'-bis-1,3,5-Triazine-4,4'-diamino-stilbene-2,2'-disulfonic Acid | 2 g |
| Water added to make | 1 liter |
| pH 6.8 | |
| Stabilization Solution: | |
| Polyethylene Glycol (40% aqueous solution; molecular weight - 400) | 10 ml |
| Formaldehyde (37% aqueous solution) | 8 ml |
| Water added to make | 1 liter |
| pH 7.5 | |

When the bleaching agent was not added to the blix solution in the above procedure, 1 minute and 30 seconds were required to finish the blix step.

EXAMPLE 3

A cellulose triacetate film base was coated with a black antihalation layer, a red-sensitive silver iodobromide emulsion layer containing 1-hydroxy-4-chloro-N-dodecyl-2-hydroxy-2-naphthamide, a green-sensitive silver iodobromide emulsion layer containing 1-(2,4,6-trichlorophenyl)-3-[3-(N-butyltetradecaneamido-propaneamido]pyrazoline-5-on, a yellow filter layer, a blue-sensitive silver iodobromide emulsion layer containing 4-benzoylacetamide-N-butyl-N-octylbenzoamide, and a gelatin protective layer in this order to provide a color photographic reversal film.

The color photographic film was exposed through an optical wedge by means of a sensitometer and then processed by the following processing steps.

| Processing Steps | | |
|---|---|---|
| 1. Black & White Development | 24°C | 8 minutes |
| 2. Step Hardening | " | 3 minutes |
| 3. Wash | 20–24°C | 3 minutes |
| 4. Reversal Exposure (500 watt 1 meter) | | 2 minutes |
| 5. Color Reversal | 24°C | 12 minutes |
| 6. Wash | 20–24°C | 4 minutes |
| 7. Rinse | " | 4 minutes |
| 8. Wash | " | 1 minutes |
| 9. Bleach | " | 5 minutes |
| 10. Wash | " | 1 minutes |
| 11. Fix | " | 4 minutes |
| 12. Wash | " | 8 minutes |
| 13. Stabilization | " | 1 minutes |
| 14. Drying | below 35°C | |

The processing solutions used in the above steps had the following compositions.

| | |
|---|---|
| Black & White Developer: | |
| Sodium Hexametaphosphate | 2 g |
| Phenidone | 0.5 g |
| Sodium Sulfite (Anhydrous) | 40 g |
| Sodium Carbonate (Anhydrous) | 40 g |
| Potassium Bromide | 2 g |
| Sodium Thiocyanate | 2 g |
| 6-Nitrobenzimidazole Nitrate (0.2%) | 10 ml |
| Water added to make | 1 liter |
| pH 10.3 | |
| Stop Hardening Solution: | |
| Chromium Alum | 30 g |
| Water added to make | 1 liter |
| pH 3.5 | |
| Rinse Solution: | |
| Potassium Pyrosulfite | 30 g |
| Water added to make | 1 liter |
| pH 4.6 | |
| Bleach Solution: | |
| Sodium Carbonate (Anhydrous) | 10 g |
| Potassium Bromide | 50 g |
| Ferric Complex Salt of Ethylenediamine Tetraacetic Acid | 100 g |
| Bleaching Promotor (1,3-dichloro-5,5-dimethylhydantoin) | 1 g |
| Water added to make | 1 liter |
| pH 6.5 | |

The compositions of the color developer, the fix solution, and the stabilization solution were the same as those in Example 1.

When the bleaching promotor was not used in the bleach solution in the above example, more than 10 minutes were required to finish the bleaching step.

EXAMPLE 4

When the same procedure as described in Example 1 was repeated using, however, 2 g of 1,3-di-iodide-5,5-dimethylhydantoin instead of 250 mg of N-iodosuccinimide as the bleaching promotor, the bleaching step was finished in 5 minutes.

EXAMPLE 5

By repeating the developing procedure as described in Example 2 using the blix solution shown below instead of the blix solution in Example 2, the results shown in the following table were obtained. From the results it can be understood that the bleaching period of time could be effectively shortened by using the bleaching agent according to this invention.

| | |
|---|---|
| Blix Solution: | |
| Ferric Complex Salt of Ethylenediamine Tetraacetic Acid | 40 g |
| Sodium Sulfite | 5 g |
| Ammonium Thiosulfate | 120 g |
| Bleaching Agent (as shown in the table) | |
| Water added to make | 1 liter |

Table

| Bleaching Promotor | Amount | Bleaching Time |
|---|---|---|
| None (control) | — | 4 minutes |
| N-Iodosuccinimide | 112 mg | 2 min. 10 sec. |
| 1,3-Di-iodo-5,5-dimethyl-hydantoin | 190 mg | 2 minutes |
| 1,3-Dibromo-5,5-dimethyl-hydantoin | 100 mg | 1 min. 50 sec. |
| 1,3-Dichloro-5,5-dimethyl-hydantoin | 100 mg | 1 min. 40 sec. |
| N,N'-Dibromodiethyl Barbituric Acid | 120 mg | 1 min. 30 sec. |

While the invention has been described in detail and with reference to specific embodiments thereof, it will be apparent to one skilled in the art that various changes and modifications can be made therein without departing from the spirit and scope thereof.

What is claimed is:

1. A bleaching method for a color photographic material which has been subjected to imagewise exposure and development, said bleaching method comprising processing the developed photographic material with an aqueous solution containing (1) a metal complex salt of an organic acid as a bleaching agent, said metal selected from the group consisting of iron (III), cobalt (III) and copper (II), and (2) a compound

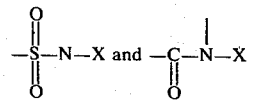

represented by the general formula

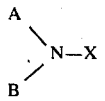

wherein A represents —COR, —$SO_2R$, or R; B represents —COR′, —$SO_2R'$, a hydrogen atom or an alkali metal atom, at least one of A and B being —COR, —$SO_2R$, —COR′ or —$SO_2R'$; X represents a halogen atom; and R and R′ each represents an akyl group, an aralkyl group or an aryl group; said R and R′ may combine to form a cyclic compound selected from the group consisting of a N-halogen phthalimide, a N-halogen succinimide, a N-halogen saccharin, a N-halogen barbituric acid, a N-halogen hydantoin and a N-halogen isocyanuric acid, and said cyclic compound may have two or more nitrogen atoms each substituted with a halogen atom.

2. The bleaching method of claim 1, in which said aqueous solution is used as a color photographic process bleach solution.

3. The bleaching method of claim 1, in which said aqueous solution is used as a color photographic process blix solution containing a fixing agent and a bleaching agent.

4. The bleaching method of claim 1, in which said compound is selected from the group consisting of N-chlorophthalimide, N-bromophthalimide, N-chlorosuccinimide, N-bromosuccinimide, N-iodosuccinimide, N-chlorosaccharin, N-iodosaccharin, N-bromosaccharin, N,N′-dichlorodiethylbarbituric acid, N,N′-dibromodiethylbarbituric acid, 1,3-dibromo-5,5-dimethylhydantoin, 3-chloro-5,5′-dimethylhydantoin, 1,3-dichloro-5,5-dimethylhydantoin, 1,3-dibromo-5,5-dimethylhydantoin, 1,3-diiodo-5,5-dimethylhydantoin, sodium dichloroisocyanurate, potassium dichloroisocyanurate, trichloroisocyanuric acid, N-bromo-ε-caprolactam, N-bromoacetamide, N-iodobutylamide, N-iodobenzamide, benzenesulfonchloramide sodium salt (di-hydrate), and p-toluenesulfonchloramide sodium salt (di-hydrate).

5. The bleaching method of claim 1, in which said aqueous solution contains said compound at about 0.005 to about 50 g per liter of said aqueous solution.

6. The bleaching method of claim 1, in which said metal complex salt is a ferric complex salt.

7. The bleaching method of claim 1, in which the organic acid of said metal complex salt is an organic acid represented by the formula

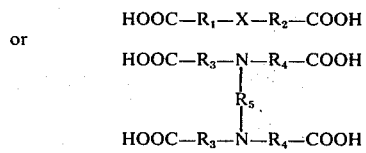

wherein X represents a hydrocarbon group, an oxygen atom, a sulfur atom, or —$NR_6$; $R_1$, $R_2$, $R_3$, $R_4$, and $R_5$ each represents a hydrogen atom or a hydrocarbon group; and $R_6$ represents a hydrogen atom or a hydrocarbon group; or an alkali metal or ammonium salt of said organic acid.

8. The bleaching method of claim 1, in which said aqueous solution contains said metal complex salt at about 20 to 200 g per liter of said aqueous solution.

9. The bleaching method of claim 3, in which said fixing agent in said blix solution is selected from the group consisting of a thiosulfate, a thiocyanate, a sulfur-containing organic dibasic acid, an organic diol, and imidazolidinethion.

10. The bleaching method of claim 3, in which said blix solution contains said fixing agent at about 40 g to 400 per liter of said blix solution.

11. The bleaching method of claim 1, in which said aqueous solution has a pH of about 5.0 to about 7.5.

* * * * *